US005481898A

United States Patent [19]

Bakermans

[11] Patent Number: 5,481,898

[45] Date of Patent: Jan. 9, 1996

[54] TOOLING MODULE FOR A STAMPING AND FORMING MACHINE

[75] Inventor: Johannes C. W. Bakermans, Harrisburg, Pa.

[73] Assignee: The Whitaker Corporation, Wilmington, Del.

[21] Appl. No.: 234,906

[22] Filed: Apr. 28, 1994

[51] Int. Cl.[6] ..... B21J 9/18

[52] U.S. Cl. ..... 72/450; 83/630; 100/281

[58] Field of Search ..... 72/450, 451, 407, 72/408; 100/280, 281, 286; 83/630

[56] References Cited

U.S. PATENT DOCUMENTS

| | | | |
|---|---|---|---|
| 4,449,421 | 5/1984 | Olschewski et al. | 72/450 |
| 4,497,196 | 2/1985 | Bakermans et al. | 72/405 |
| 4,664,004 | 5/1987 | Randall | 83/630 |
| 4,819,476 | 4/1989 | Bakermans et al. | 72/456 |
| 4,916,932 | 4/1990 | Obrecht et al. | 72/450 |
| 4,959,989 | 10/1990 | Obrecht et al. | 72/450 |
| 5,007,282 | 4/1991 | Bakermans | 72/481 |
| 5,309,751 | 5/1994 | Ryan | 72/450 |

*Primary Examiner*—David Jones
*Attorney, Agent, or Firm*—William B. Noll

[57] ABSTRACT

An articulated ram assembly in a tooling module for a stamping and forming machine is disclosed. The ram assembly has a first member that is caused to reciprocate within a passageway in a box structure by a lever eccentrically coupled to a drive shaft. The ram assembly includes a second member that is in sliding engagement with the first member and coupled thereto by means of four links. The links are pivotally attached to one of the members and are pivotally coupled through slide blocks to the other member. The links are also pivotally coupled by slide blocks to the box structure so that as the first member undergoes reciprocating motion within the box structure the second member undergoes reciprocating motion at a different rate than the first member. Therefore, the length of stroke of the second member is different than the length of stroke of the first member.

20 Claims, 6 Drawing Sheets

TOOLING MODULE FOR A STAMPING AND FORMING MACHINE

The present invention is related to tooling modules for stamping and forming machines of the type having a short stroke tooling ram and more particularly to a mechanism within the tooling ram that effectively lengthens the stroke.

BACKGROUND OF THE INVENTION

U.S. Pat. Nos. 4,497,196 and 4,819,476, both off which are incorporated herein by reference, disclose a stamping and forming machine having two tooling modules, each of which has first and second ram assemblies which are reciprocable toward and away from each other along horizontal paths of reciprocation. Strip material is fed along a strip feed path which extends between the ram assemblies. The ram assemblies have tooling on their ends for performing stamping and forming operations on the strip. The ram assemblies are reciprocated by oscillating levers to which the are coupled. The levers, in turn, are coupled to a central power shaft by eccentric assemblies. One example of typical punch and die tooling for use in a stamping and forming machine is disclosed in U.S. Pat. No. 5,007,282, which is incorporated herein by reference.

The rams of this type of machine usually have a relatively short stroke, in the order of about 0.500 inch. Certain stamping and forming machine products require the use of deep draw dies which, in turn, require a ram stroke that is longer than that available. Since it is not practical to increase the ram stroke of this type of machine, in these situations, it is desirable to provide an articulated ram having the capability within the ram itself to increase the effective length of stroke of the tooling on the end of the ram while the actual length of the stroke at the driven end of the ram remains unchanged.

SUMMARY OF THE INVENTION

A stamping and forming machine is disclosed for performing stamping and forming operations on strip stock. The machine including a drive shaft and first and second ram assemblies which are reciprocative within a box, having a box-like interior, toward and away from each other between forward and retracted positions along an axis of reciprocation. First and second actuator levers are provided for reciprocating the first and second ram assemblies, respectively, each lever being coupled to a first portion of a respective one of the ram assemblies and to the drive shaft for effecting the reciprocation of its ram assembly. Tooling is coupled to a second portion of the first ram assembly and mating tooling is coupled to a second portion of the second ram assembly, respectively, for reciprocation of the tooling and the mating tooling toward each other for performing the operations and away from each other. Apparatus interconnecting the first and second portions is provided so that during the reciprocation the second portion moves at a different rate than does the first portion.

DESCRIPTION OF THE PREFERRED EMBODIMENT

Figure 1:
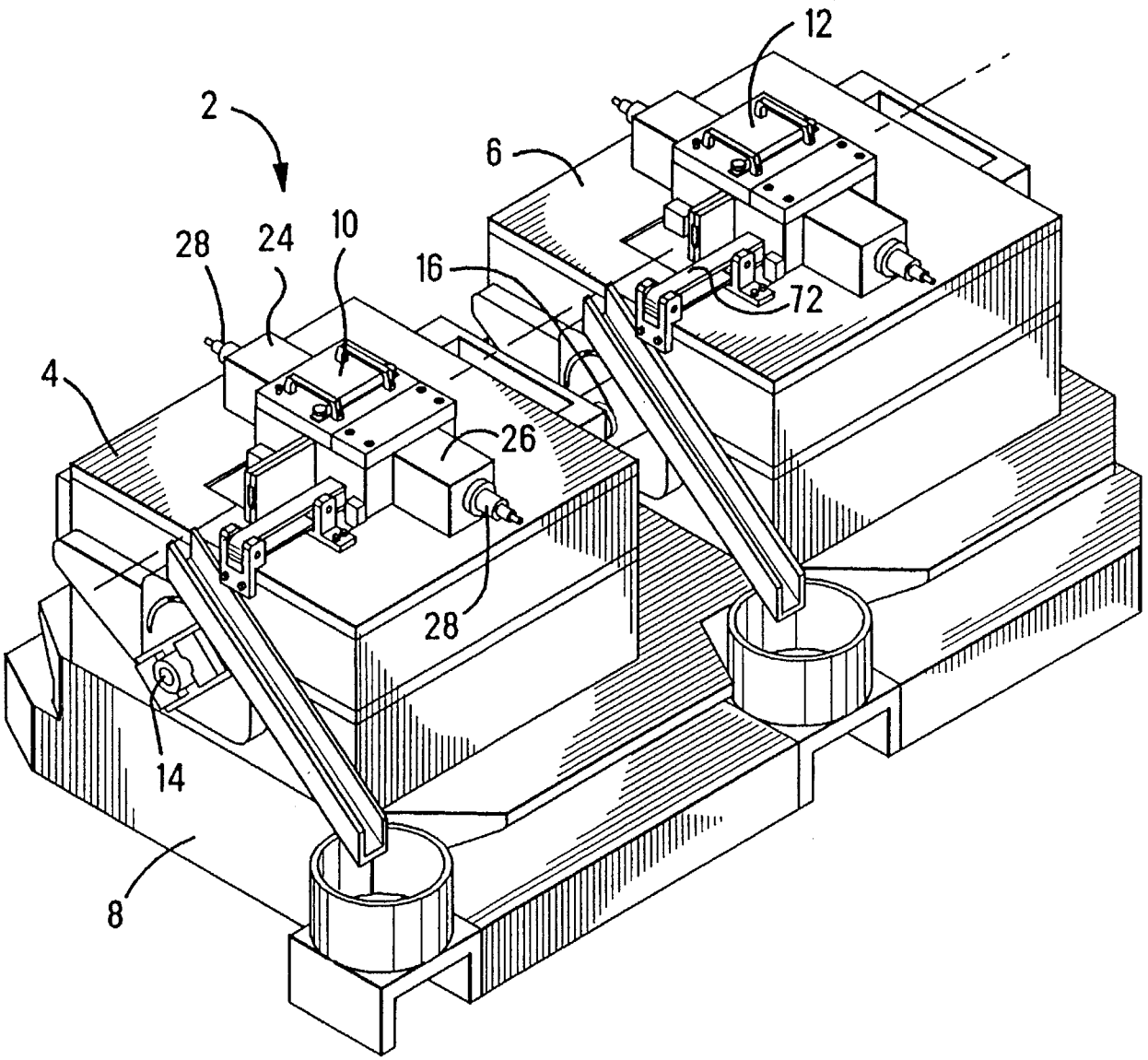
FIG. 1 is an isometric view of a two module stamping and forming machine incorporating the teachings of the present invention.
Figure 2:
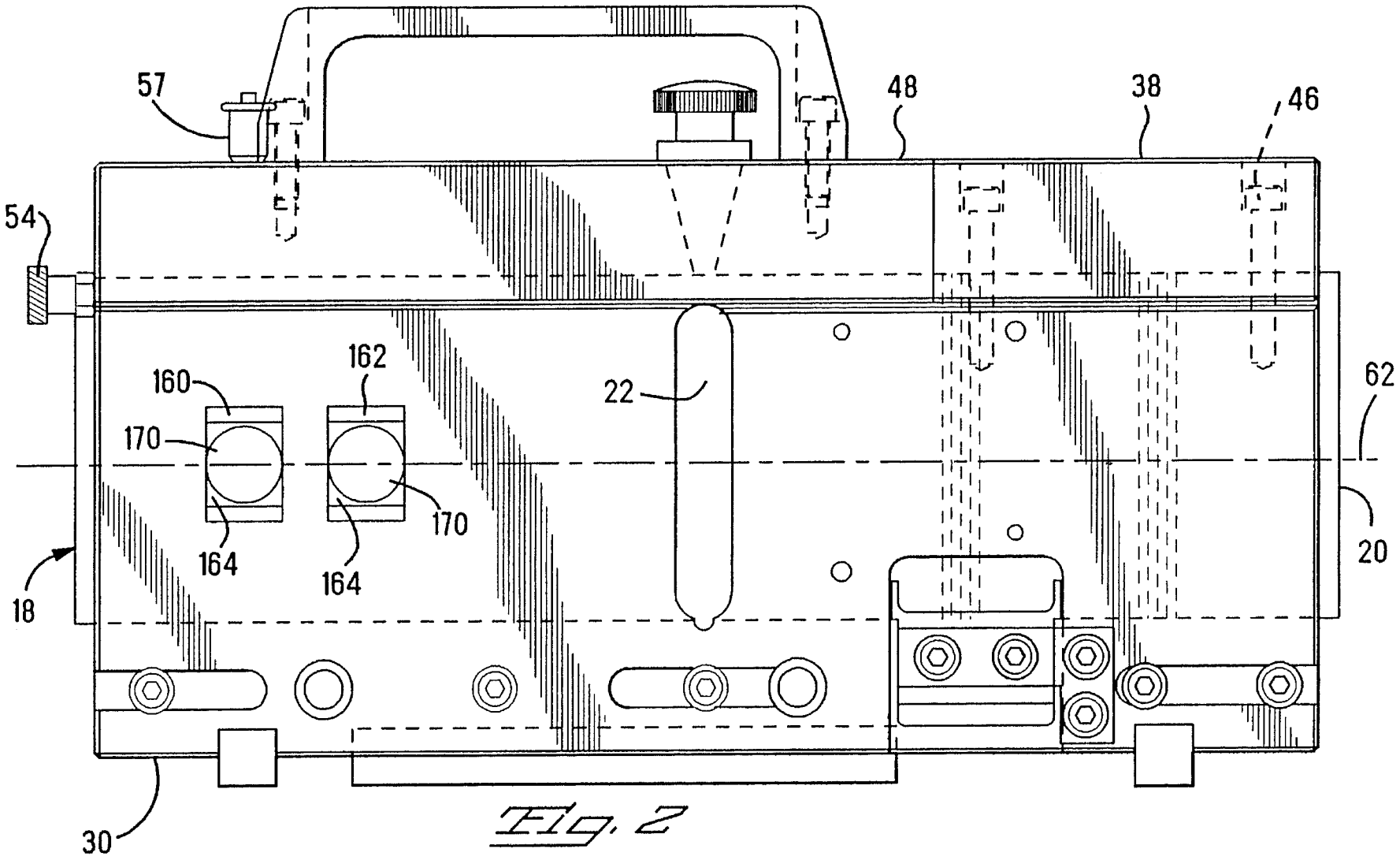
FIG. 2 is a front view of a tooling assembly incorporating the teachings of the present invention.

There is shown in FIG. 1 a stamping and forming machine 2 having a first stamping and forming module 4 and a second stamping and forming module 6. The first and second modules 4 and 6, are mounted to a machine base 8 and arranged in ways so that their relative spacing can be adjusted when the machine is set up for a particular job. This means of adjustment is provided to assure that the tooling in the first module will be in proper alignment with respect to the tooling in the second module so that a strip having operations performed on it in the first module will be in proper alignment in the second module for further operations there. The modules 4 and 6 have first and second tooling assemblies 10 and 12, respectively, mounted to their top mounting plates, as shown in FIG. 1. Each module has a drive shaft 14 and an electric motor, not shown, for rotating the drive shaft during operation of the machine. The motor is coupled to the drive shaft 14 by means of a belt and pulley in the usual manner. The two drive shafts 14 are rotationally coupled together by a coupling assembly 16. Each tooling assembly 12 and 14 includes a pair of opposing articulated ram assemblies 18 and 20, as best seen in FIG. 2, which contain tooling on their ends which mate to perform the stamping and forming operation on strip stock that is fed through aligned slots 22. The opposing ram assemblies of each module are arranged to reciprocate toward and away from each other along horizontal paths. The rams are caused to reciprocate by means of first and second levers 24 and 26 which are coupled to their respective rams by couplings 28 as shown in FIG. 1. Each lever 24, 26 is pivoted intermediate its ends while its lower end is coupled to the drive shaft 14 by means of a pair of eccentrically coupled links, not shown.

Figure 3:
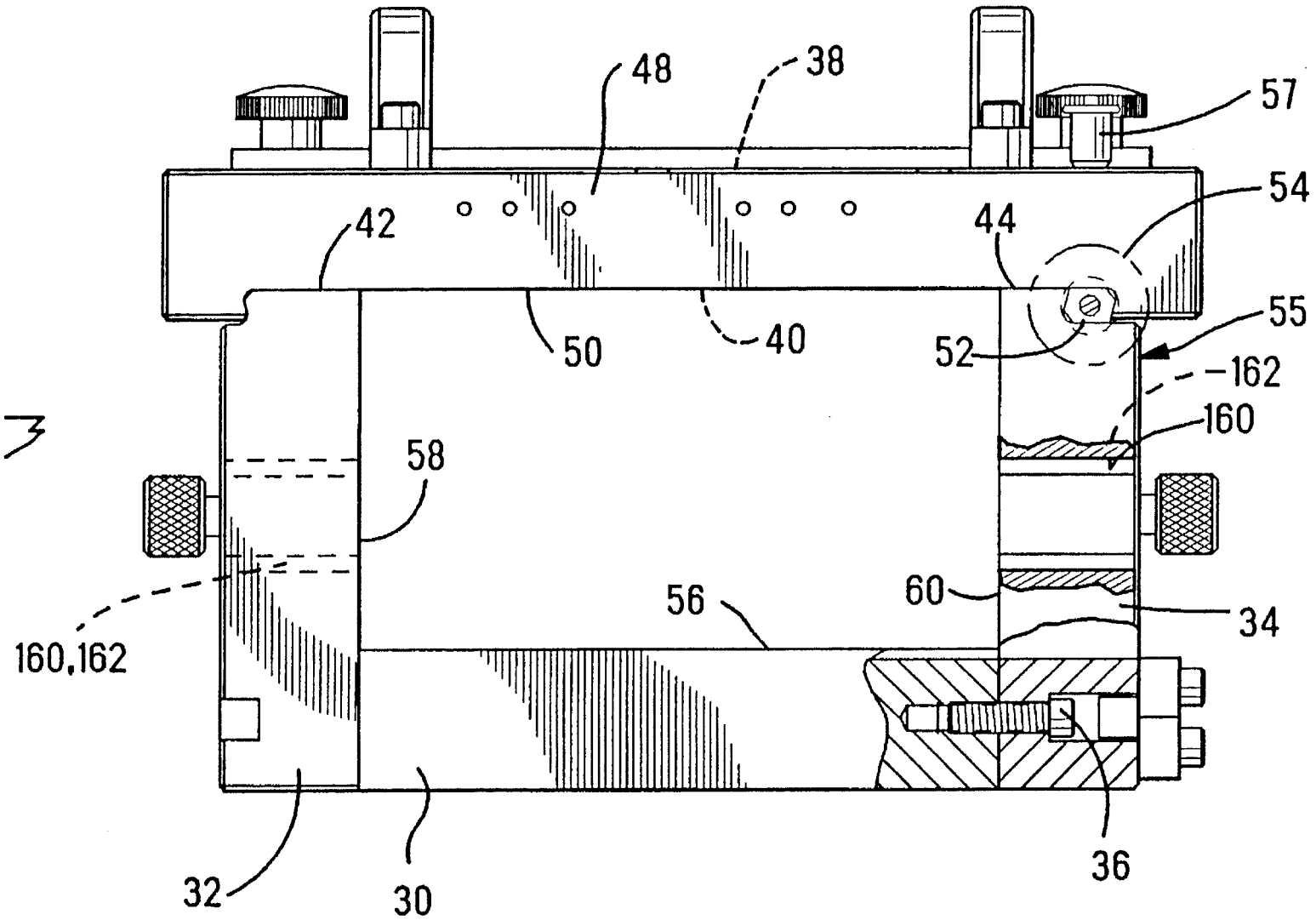
FIG. 3 is an end view of the tooling assembly shown in FIG. 2.
Figure 4:
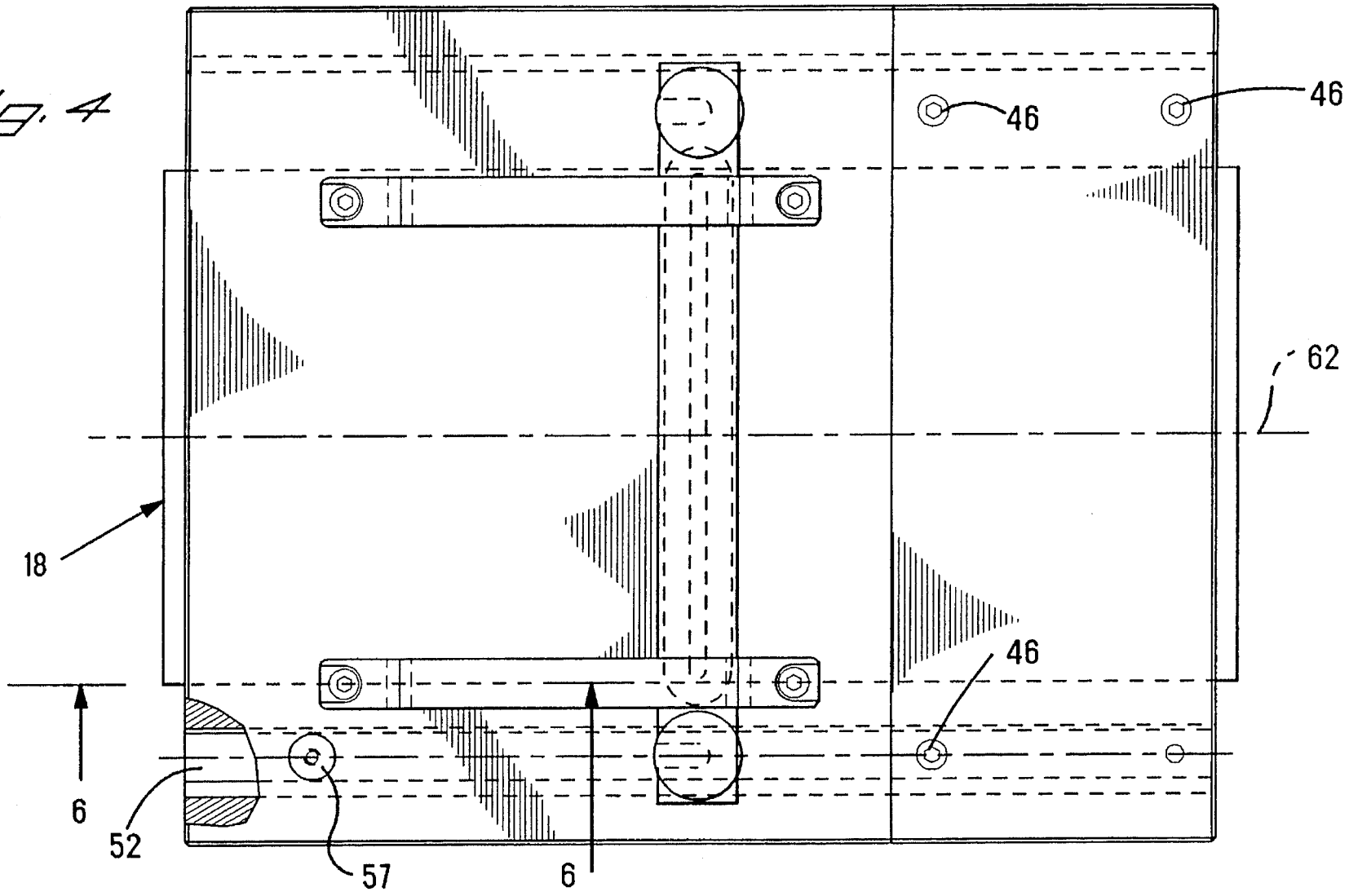
FIG. 4 is a plan view of the tooling assembly shown in FIG. 2.

The tooling assembly 10 will now be described in more detail. It will be understood that the tooling assembly 14, although not identical, is arranged and functions in a similar manner as the tooling assembly 10 and therefore will not be described here. The tooling assembly 10, as seen in FIGS. 2, 3, and 4, is shown exclusive of the module 4 and the first and second levers 24 and 26. The tooling assembly 10 includes a base plate 30 that is keyed and secured to the module 4 by screws in the usual manner. A left side plate 32 and a right side plate 34 are attached to opposite edges of the base 30 by means of the screws 36, as best seen in FIG. 3. A top plate 38 having a flat surface 40 is attached to top mounting surfaces 42 and 44 of the first and second side plates by means of four screws 46. The top plate 38 only covers a portion of the top surfaces of the first and second side plates, as best seen in FIGS. 2 and 3. The remaining portion is covered by a cover plate 48 having a flat surface 50 which is coplanar with the surface 40. The cover plate 48 is removably attached to the top surfaces 42 and 44 of the left and right side plates by two sets of dovetail halves as shown in FIG. 3, the two halves of each set being mutually opposing. The outer top edges of both the left and right side plates 32 and 34 have mating dovetail halves, formed outwardly along their entire lengths. A gib 52 is disposed within the space between the opposing right dovetail halves as shown in FIG. 3 and extends for substantially the entire length of the cover plate 48. A knurled knob 54, shown in solid lines in FIG. 2 and in phantom lines in FIG. 3, is used for removing the gib 52. The gib 52 is held in place by means of a ball lock pin 54 having a shank that extends through a hole in the cover plate 48, a hole in the gib 52, and a blind hole in the surface 44 of the right side plate 34. As best seen in FIG. 3, the right and left side plates, 34 and 32 respectively, and the base plate 30 along with the top plate 40 and cover plate 48 define a rigid box structure 55 having a rectangularly shaped interior that forms a passageway for the two ram assemblies. The passageway has a lower surface 56, left and right side walls having surfaces 58 and 60, respectively, and a top surface consisting of the two surfaces 40 and 50. As mentioned above and as shown in FIGS. 2 and 4, a punch ram assembly 18 and a die ram assembly 20 are positioned within the passageway and are in sliding engagement with the surfaces 40, 50, 56, 58, and 60. The rams are coupled to the levers 26 and 24 by means of the couplers 28 for undergoing reciprocating motion. The two rams are coupled to tooling such as punches, dies, and various kinds of forming tools that operate on strip material that is passed through the opening 22. The ram assemblies 18 and 20 and their coupled tooling are a slip fit with the passageway and reciprocate there within along a horizontal axis 62.

Figure 5:
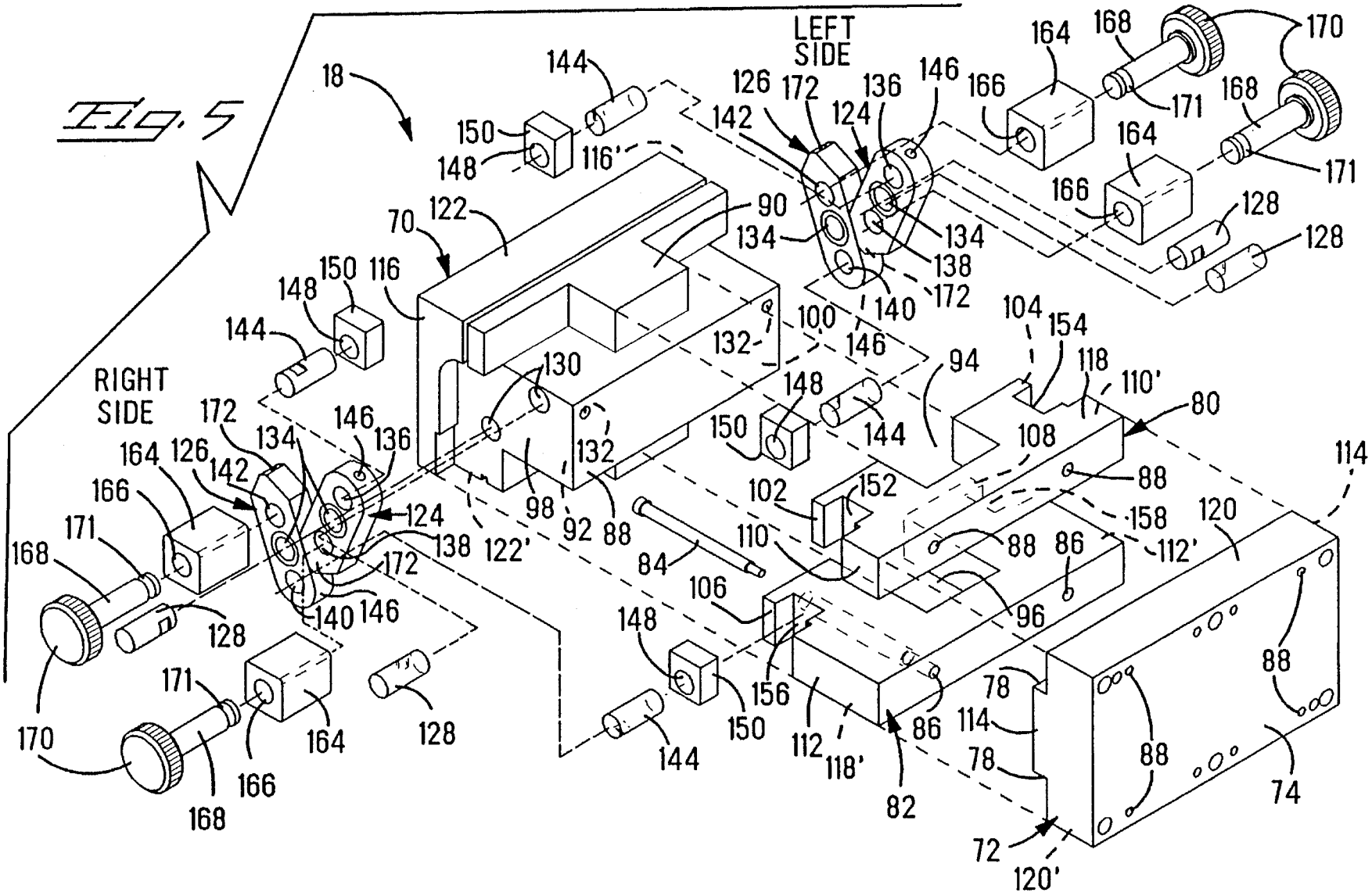
FIG. 5 is an exploded parts view of a ram assembly shown in FIG. 2.
Figure 6:
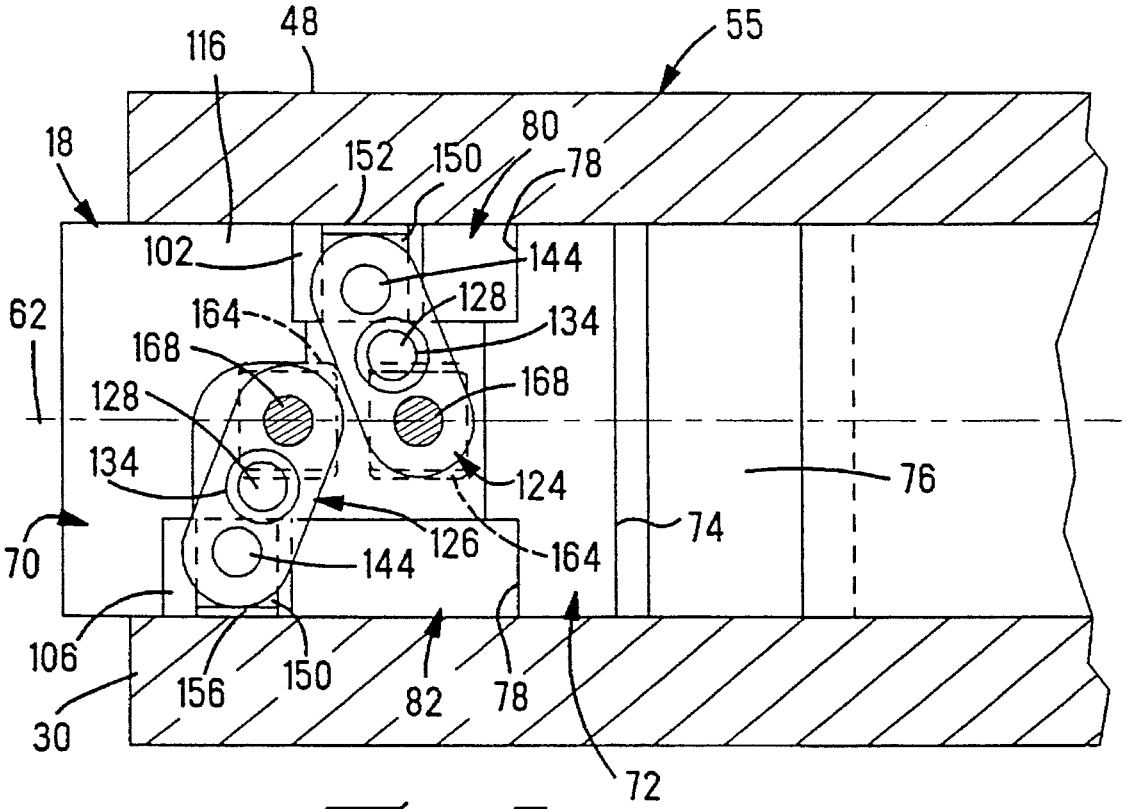
FIGS. 6 and 7 are partial cross-sectional views taken along the lines 6—6 in FIG. 4 showing the ram assembly in two different positions.
Figure 7:
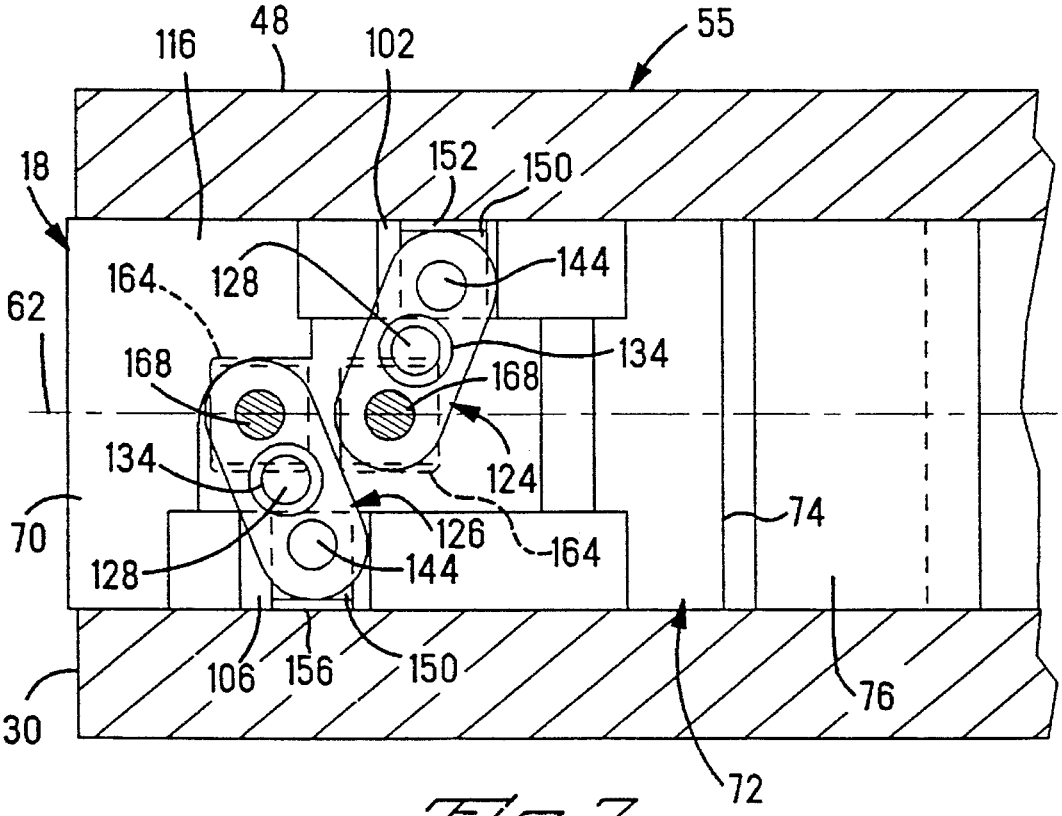

The punch and die ram assemblies 18 and 20, respectively, are substantially similar with respect to the present invention, therefore, only the punch ram assembly 18 will be described in detail. The ram assembly 18, as best seen in FIGS. 5, 6, and 7, includes a first member 70, which as set forth above, is coupled to the link 24 by means of the coupling 28, and a second member 72 having a mounting surface 74 to which punch tooling 76 is mounted. The second member 72 includes a pair of rabbets 78 arranged to locatingly receive an upper plate 80 and a lower plate 82. Two screws 84 extend through centerboard holes 86 in each of the two plates 80 and 82 and into threaded holes 88 in the second member 72 to form a rigid U-shaped member. The first member 70 has a block 88 that is sized to be a slip fit between the upper and lower plates 80 and 82. Additionally, the block 88 has a rectangular projection 90 on its top surface and a similar projection 92 on its bottom surface that slidingly engage respective mating openings 94 and 96 formed in the plates 80 and 82, respectively, therefore, the first and second members 70 and 72 are intermating members that matingly engage. Each of the projections 90 and 92 is sized to be a slip fit with its respective opening 94, 96. The block 88 has opposite right and left side surfaces 98 and 100, respectively that are mutually parallel. The upper plate 80 has opposite surfaces 102 and 104 that are substantially flush with the surfaces 98 and 100, respectively. Similarly, the bottom plate 82 has opposite surfaces 106 and 108 that are substantially flush with the surfaces 98 and 100, respectively.

The outer surfaces of the ram assembly 18 are sized to be a slip fit with the surfaces 50, 56, 58, and 60 of the box structure 55, shown in FIG. 3. The upper and lower plates 80 and 82 have side surfaces 110 and 112 that are flush with an end surface 114 of the second member 72 and an end surface 116 of the first member 70, all of which are in sliding engagement with the surface 60 of the box structure 55. Similarly, the upper and lower plates 80 and 82 have opposite side surfaces 110' and 112' that are flush with an opposite end surface 114' of the second member 72 and an opposite end surface 116' of the first member 70, all of which are in sliding engagement with the surface 50 of the box structure 55. The upper plate 80 has a top surface 118 that is flush with a top surface 120 of the second member 72 and a top surface 122 of the first member 70, all of which are in sliding engagement with the surface 50 of the box structure 55. Similarly, the lower plate 82 has a bottom surface 118' that is flush with a bottom surface 120' of the second member 72 and a bottom surface 122' of the first member 70, all of which are in sliding engagement with the surface 56 of the box structure 55.

First and second links 124 and 126, respectively, are arranged on each side of the block 80 and are pivotally attached thereto by means of pins 128. Each pin 128 is arranged in a hole 130 in the block and held in place by a set screw 132. The pins 128 extend outwardly from the block 88 by an amount equal to slightly less than the thickness of the links 124, 126. A needle bearing 134 is arranged in a hole in each link and pivotally engages a respective pin 128. Each link 124 has a hole 136 through a first end and a hole 138 through a second end. Similarly, each second link 126 has a hole 140 through a first end and a hole 142 through a second end. Four pins 144, two on each side, are arranged so that one pin is in each hole 136 and 140 extending beyond the surface 98 on the right side of the block 88, and beyond the surface 100 on the left side. The pins 144 are held in their respective holes 136 and 140 by means of set screws 146 and extend into slip fit holes 148 in slide blocks 150. There are two slots, a right slot 152 and a left slot 154 formed in the surfaces 102 and 104, respectively, of the top plate 80. These slots are positioned to receive the slide blocks 150 that pivotally engage the two first links 124. Similarly, there are two slots, a right slot 156 and a left slot 158 formed in the surfaces 106 and 108, respectively, of the bottom plate 82. These slots are positioned to receive the slide blocks 150 that pivotally engage the two second links 126. The slide blocks 150 slidingly engage their respective slots 152, 154, 156, and 158. The thickness of the first and second links 124 and 126 is chosen so that when the ram assembly 18 is in position within the passageway of the box structure 55 the links have a slight amount of clearance between the block 88 and the walls of the box.

The right and left side plates 34 and 32 each have a pair of rectangular holes 160 and 162 that extend completely therethrough, as shown in FIGS. 2 and 3. Four slide blocks 164 are arranged so that one slide block is in each rectangular hole. Each of the slide blocks is sized to be a slip fit with the vertical walls of its respective rectangular hole, however, there is sufficient clearance between the slide block and the top and bottom surfaces of the holes to permit vertical motion of the slide block. As shown in FIGS. 3 and 5, each slide block has a hole 166 therethrough in alignment with one of the holes 138 and 142 in the second ends of the first and second links 124 and 126, respectively. Four locking pins 168 having enlarged knurled heads 170 and are arranged so that one pin 168 extends through each of the holes 166 and into a respective holes 138 or 142 of a respective link. Each of the pins 168 includes a groove 170 near its free end that engages a spring loaded ball plunger 172 that is threaded into each of the second ends of the links 124 and 126. The ball plungers act as detents to hold the pins 168 within their respective holes 138 and 142 during operation of the machine 2. The pins 168 can be easily pulled out of the holes 166 when it is desired to remove the ram assembly 18 from the box structure 55 for maintenance.

In operation, the lever 24 and coupling 28 cause the ram assembly 18 to undergo reciprocating movement within the passageway of the box structure 55, as set forth above. As best seen in FIG. 6, the ram assembly 18 begins its stroke from its left most position with respect to the box structure 55. In this position the first and second members 70 and 72, respectively, are in their closed relative position, that is, the two parts are telescoped together. Similarly, the die ram assembly 20, not shown in FIG. 6, has first and second members that are in their closed position so that the opposing punch and die tooling are away from each other to their furthest extent. As the lever 24 begins to push the ram assembly 18 toward the right, as viewed in FIG. 6, the first member 70 and the attached pins 128 begin to move toward the right. Note that the locking pins 168, extending through the holes in the second ends of the links 124 and 126, also extend through holes in the four slide blocks 164 which are confined within the rectangular holes 160 and 162 on each side of the box structure. This prevents the second ends of the links 124 and 126 from moving toward the right along with the ram assembly 18, therefore, the two links, on each side, are forced to pivot about the pins 128, the first link 124 pivoting in a clockwise direction and the second link 126 pivoting in a counterclockwise direction, as viewed in FIG. 6. As the two links 124 and 126 pivot, their first ends containing the pins 144 move toward the right at a faster rate than do the pins 128. This faster rate of movement of the pins 144 is transferred through the slide blocks 150 in the slots 152 through 158, to the top and bottom plates 80 and 82, respectively, and the second member 72 and attached tooling 76. As the lever 24 continues to move the first member 70 toward the right, the second member 72 also moves toward the right at a faster rate until the lever has reached the end of its movement. At this point the ram assembly 18 is at the end of its stroke, as shown in FIG. 7, where the second member 72 is fully extended so that the tooling 76 is in operational engagement with mating tooling, not shown, that is on the ram assembly 20. It will be appreciated by those skilled in the art that the second member 72 has undergone a longer stroke than has the first member 70. At this point the lever 24 reverses direction and, through the coupling 28, begins to move the first member 70 toward the left, as viewed in FIG. 7. This causes the pins 128 to also move toward the left and, since the pins 168 are pivotally coupled to the box structure 55, the links 124 and 126 begin to pivot about the pins 128, the fist link 124 pivoting counterclockwise and the second link pivoting clockwise. This causes the pins 144 in the first ends of the links 124 and 126 to move toward the left, at a faster rate than the pins 128, thereby moving the second member 72 and attached top and bottom plates 80 and 82 toward the left at the faster rate. This movement continues until the lever 24 has reached the end of its movement and the first and second members 70 and 72 of the ram assembly 18 have fully telescoped together to their closed position and are in their left most position as shown in FIG. 6. Note that as the links 124 and 126 pivot about their pins 128, the slide blocks 150 slide vertically a small amount within the slots 152 and 156 on the right side, and the slots 154 and 158 on the left side. Similarly, the slide blocks 164 also slide a small amount vertically within their respective rectangular holes 160 and 162.

The degree of difference of the rate of movement between the first and second members 70 and 72 is controlled by the distances between the pins 144 and 128 and between the pins 128 and 168. By varying the ratio of these distances the relative rate of movement of the first and second members can by adjusted to a desired value so that a stroke of a particular length can by achieved. Additionally, by slightly restructuring the ram assembly 18 and repositioning the pivot points of the links 124 and 126 the relative rate of movement of the two members can be reversed. That is, the second member 72 will move at a rate that is less than that of the first member 70 so that the length of the stroke for the second member 72 is less than that of the first member 70.

An important advantage of the present invention is that operations requiring a relatively long ram stroke can be performed on a machine having a ram that is limited to a shorter stroke. Additionally, the stroke of the tooling can be made shorter than the stroke of the ram thereby providing a mechanical advantage when relatively more force is required in operations such as coining.

I claim:

1. In a stamping and forming machine for performing stamping and forming operations on strip stock, said machine including a drive shaft, first and second ram assemblies which are reciprocative within a box, having a box-like interior, toward and away from each other between forward and retracted positions along an axis of reciprocation, first and second actuator levers for reciprocating said first and second ram assemblies, respectively, each ram assembly having a first portion and a second portion, both said first and second portions being in sliding engagement with said box-like interior, each lever being coupled to said first portion of a respective one of said ram assemblies and to said drive shaft for effecting said reciprocation of its said ram assembly, tooling coupled to said second portion of said first ram assembly and mating tooling coupled to said second portion of said second ram assembly, respectively, for reciprocation of said tooling and said mating tooling toward each other for performing said operations and away from each other, apparatus interconnecting said first and second portions so that during said reciprocation said second portion moves at a different rate than does said first portion.

2. The machine according to claim 1 wherein said first and second portions are first and second intermating members arranged to slide toward and away from each other along said axis of reciprocation.

3. The machine according to claim 2 including a first link pivotally attached to one of said intermating members and having a pivot axis that is substantially perpendicular to said axis of reciprocation, said first link having a first end pivotally coupled to the other of said intermating members and a second end pivotally coupled to said box.

4. The machine according to claim 3 wherein said pivotal coupling of one of said first and second ends of said link to its respective said other intermating member or said box, includes a slide arranged to slide in a direction that is substantially perpendicular to said axis of reciprocation, and a pin in pivotal engagement with said slide.

5. The machine according to claim 4 where said pin is attached to said link and said slide is in sliding engagement with a slot in said other intermating member or said box.

6. The machine according to claim 3 including a second link pivotally attached to said one of said intermating members and having a pivot axis that is substantially perpendicular to said axis of reciprocation, said second link having a first end pivotally coupled to said other of said intermating members and a second end pivotally coupled to said box, said first and second links arranged so that during said reciprocation said links pivot about their respective pivot axes in opposite directions.

7. The machine according to claim 6 wherein said pivotal attachments of said first and second links are to said first intermating member and said pivotal coupling of said first end of each link is to said second intermating member.

8. The machine according to claim 7 wherein said pivotal coupling of each of said first ends to said second intermating member includes a slide in sliding engagement with a slot in said intermating member and arranged to slide in a direction that is substantially perpendicular to said axis of reciprocation, and a pin attached to said first end of said link in pivotal engagement with said slide.

9. The machine according to claim 8 wherein said pivotal coupling of each of said second ends to said box includes a slide in sliding engagement with a slot in said box and arranged to slide in a direction that is substantially perpendicular to said axis of reciprocation, and a locking pin extending through a hole in said slide and into a hole in said second end of said link.

10. The machine according to claim 9 wherein said locking pin is removably held in said hole in said second end by means of a spring plunger intersecting said hole and engaging a depression in said pin.

11. A ram assembly for undergoing reciprocating motion along an axis of reciprocation within a box-like structure having interior walls, said ram assembly having a first portion and a second portion, both said first and second portions being in sliding engagement with said ram assembly, including an actuator coupled to said first portion of said ram assembly and arranged to impart said reciprocating motion thereto, tooling for performing a manufacturing operation coupled to said second portion of said ram assembly, and apparatus interconnecting said first and second portions so that during said reciprocation said second portion moves at a different rate than does said first portion.

12. The ram assembly according to claim 11 wherein said first and second portions are first and second intermating members arranged to slide toward and away from each other along said axis of reciprocation.

13. The machine according to claim 12 including a first link pivotally attached to one of said intermating members and having a pivot axis that is substantially perpendicular to said axis of reciprocation, said first link having a first end pivotally coupled to the other of said intermating members and a second end pivotally coupled to said box.

14. The machine according to claim 13 wherein said pivotal coupling of one of said first and second ends of said link to its respective said other intermating member or said box, includes a slide arranged to slide in a direction that is substantially perpendicular to said axis of reciprocation, and a pin in pivotal engagement with said slide.

15. The machine according to claim 14 where said pin is attached to said link and said slide is in sliding engagement with a slot in said other intermating member or said box.

16. The machine according to claim 13 including a second link pivotally attached to said one of said intermating members and having a pivot axis that is substantially perpendicular to said axis of reciprocation, said second link having a first end pivotally coupled to said other of said intermating members and a second end pivotally coupled to said box, said first and second links arranged so that during said reciprocation said links pivot about their respective pivot axes in opposite directions.

17. The machine according to claim 16 wherein said pivotal attachments of said first and second links are to said first intermating member and said pivotal coupling of said first end of each link is to said second intermating member.

18. The machine according to claim 17 wherein said pivotal coupling of each of said first ends to said second intermating member includes a slide in sliding engagement with a slot in said intermating member and arranged to slide in a direction that is substantially perpendicular to said axis of reciprocation, and a pin attached to said first end of said link in pivotal engagement with said slide.

19. The machine according to claim 18 wherein said pivotal coupling of each of said second ends to said box includes a slide in sliding engagement with a slot in said box and arranged to slide in a direction that is substantially perpendicular to said axis of reciprocation, and a locking pin extending through a hole in said slide and into a hole in said second end of said link.

20. The machine according to claim 19 wherein said locking pin is removably held in said hole in said second end by means of a spring plunger intersecting said hole and engaging a depression in said pin.

* * * * *